US005494283A

United States Patent [19]

Harris

[11] Patent Number: 5,494,283

[45] Date of Patent: Feb. 27, 1996

[54] CROSSHANDLE POLICE BATON WITH HOOK AND ARM TRAP

[75] Inventor: Christopher L. Harris, Dallas, Tex.

[73] Assignee: Paul A. Harwood, Springtown, Tex.

[21] Appl. No.: 376,121

[22] Filed: Jan. 19, 1995

Related U.S. Application Data

[63] Continuation of Ser. No. 122,206, Sep. 16, 1993, abandoned.

[51] Int. Cl.[6] ..... F41B 15/02

[52] U.S. Cl. ..... 273/84 R; 119/801

[58] Field of Search ..... 119/801, 816, 119/802; 273/84 R

[56] References Cited

U.S. PATENT DOCUMENTS

| | | | |
|---|---|---|---|
| 1,301,349 | 4/1919 | Wylde . | |
| 1,817,845 | 5/1928 | Reichert . | |
| 1,845,338 | 9/1929 | Quern . | |
| 3,157,187 | 11/1964 | Murcott | 135/73 |
| 4,052,063 | 10/1977 | Wong | 273/84 R |
| 4,061,340 | 12/1977 | Husted | 273/189 |
| 4,384,574 | 5/1983 | Wong | 128/133 |
| 4,982,960 | 1/1991 | David | 273/84 |
| 5,118,108 | 6/1992 | Wilmoth, III | 273/84 |

FOREIGN PATENT DOCUMENTS

| | | | |
|---|---|---|---|
| 145881 | 4/1954 | Sweden . | |
| 2082037 | 3/1982 | United Kingdom | 119/802 |

*Primary Examiner*—William M. Pierce
*Attorney, Agent, or Firm*—Baker & Botts

[57] ABSTRACT

A passive control tool (8) is disclosed that has a ball (10), a handle (12) connected to the ball, and an arm (14) connected to the handle. The passive control tool has a weapon trap (16) connected to the handle and a striking base (18) connected to the weapon trap. The weapon trap and striking base comprise the body (19) of the passive control tool. The passive control tool has a pocket (20) connected to the striking base, an arm trap (22) connected to the pocket and a hook (24) connected to the arm trap.

20 Claims, 5 Drawing Sheets

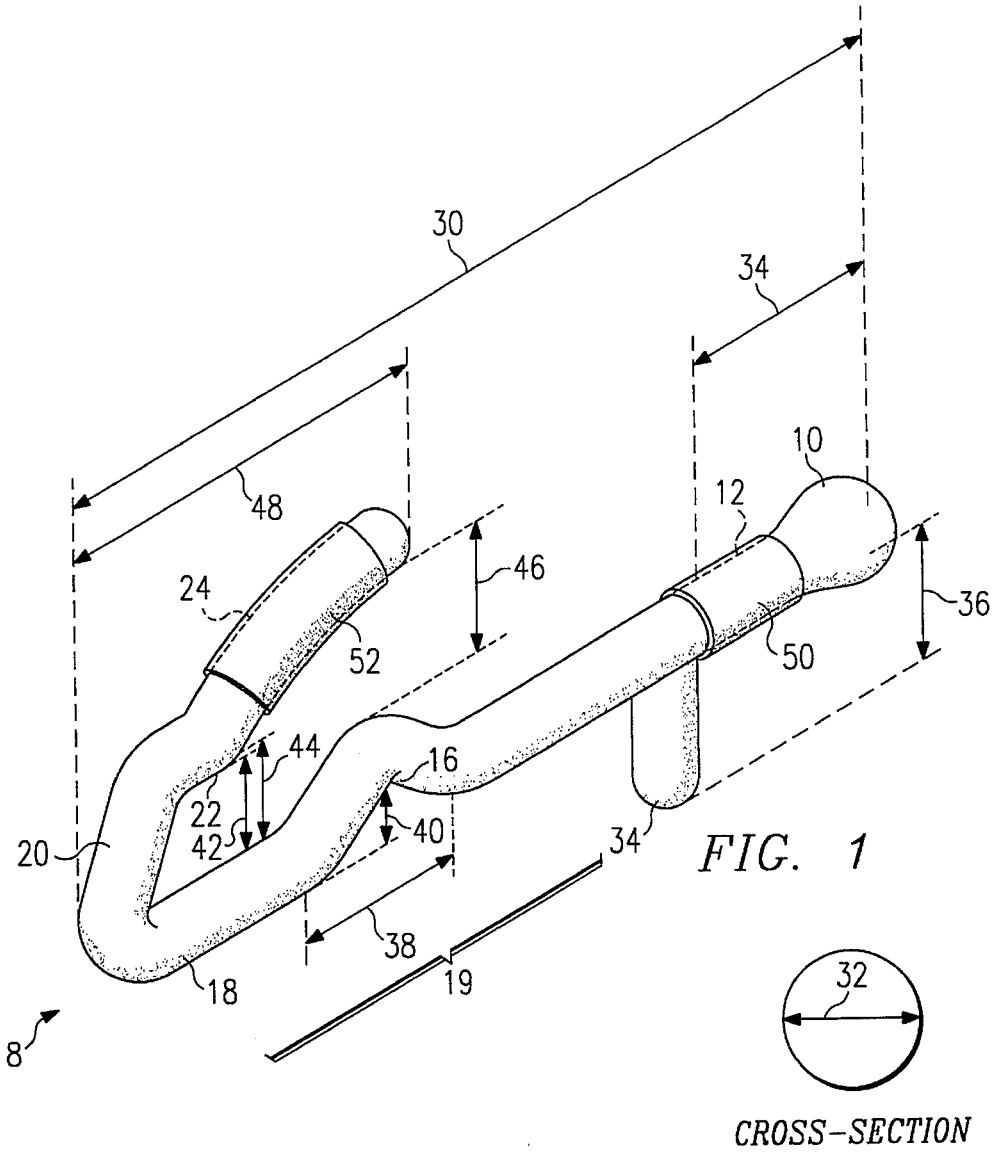
FIG. 1
FIG. 2
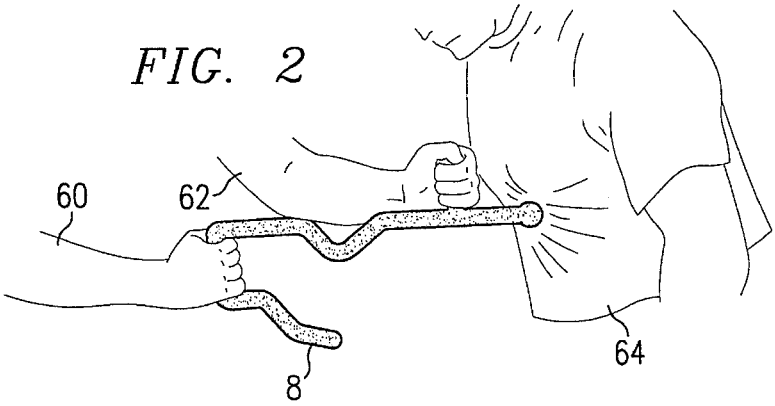

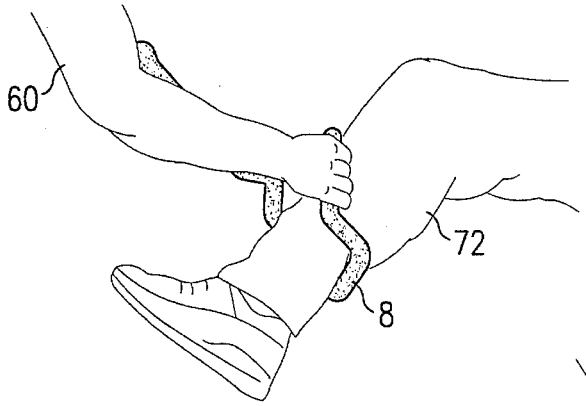
FIG. 6
FIG. 7
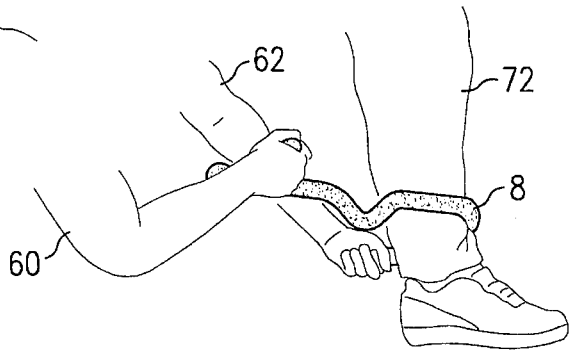
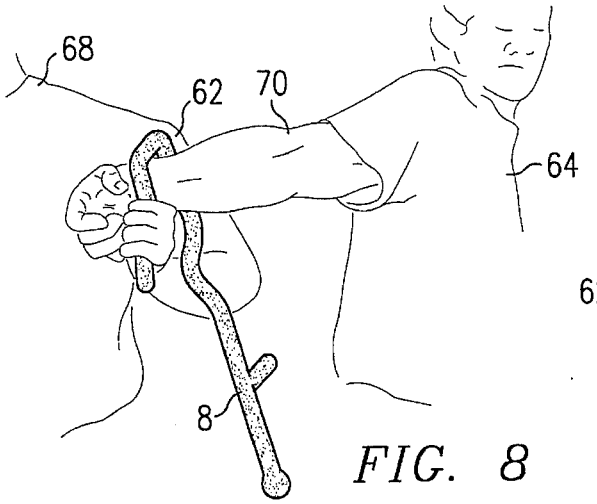
FIG. 8
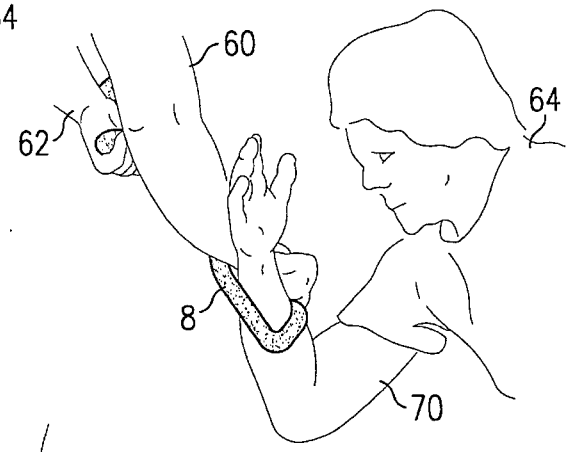
FIG. 9
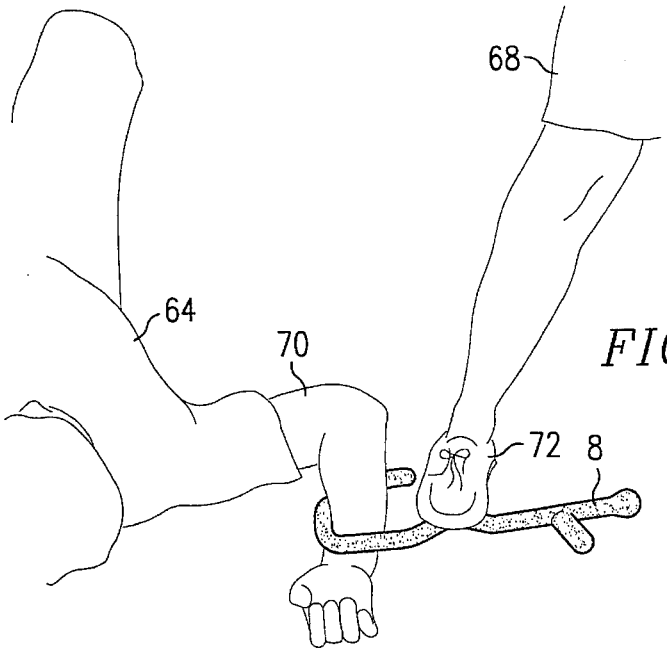
FIG. 10

CROSSHANDLE POLICE BATON WITH HOOK AND ARM TRAP

CROSS REFERENCE TO RELATED APPLICATIONS

This application is a continuation of U.S. application Ser. No. 08/122,206 filed Sep. 16, 1993, now abandoned.

TECHNICAL FIELD OF THE INVENTION

This invention relates in general to the field of passive restraint devices and more particularly to a passive control tool and methods of restraining subjects using such a passive control tool.

BACKGROUND OF THE INVENTION

Peace officers have the need for a device that they can carry at their side and use for self defense and to control human subjects. One of the least complicated devices is simply a stick with a handle at one end.

The classic night stick has been changed over the years in a variety of ways. For example, perpendicular handles and other handguards have been added to help protect the peace officer's hands. Other devices have also been used that comprise flexible rectangular-shaped metal formed into U-shaped devices. These may be used by pinching a human subject's limbs in the flexible device. Such flexible devices are not as suitable for striking and blocking and their rectangular shape contains sharp edges that can cut a human subject's skin or fracture bone.

Accordingly, a need has arisen for a passive control tool that is useful for striking, blocking and passive restraint.

SUMMARY OF THE INVENTION

In accordance with the present invention, a passive control tool and method of operation is provided that substantially eliminates or reduces disadvantages and problems associated with prior passive restraint devices.

According to one embodiment of the present invention, a passive restraint device is provided that has a handle which has a first and a second end. The passive restraint device has a body connected to the first end of the handle, a pocket connected to the body, an arm trap connected to the pocket, and a hook connected to the arm trap.

According to an alternate embodiment of the present invention, a passive control tool is provided that includes a handle that has a first and a second end and a substantially spherical ball that is connected to the first end of the handle. The passive control tool has an arm and a weapon trap connected to the handle proximate the second end of the handle. The passive control tool has a striking base connected to the weapon trap, a pocket connected to the striking base, an arm trap connected to the pocket, and a hook connected to the arm trap.

One technical advantage of the present invention inheres in the fact that the configuration of the portions of the tool allows control of a human subject with the use of only one arm once the tool has been set.

A second technical advantage of the present invention is that the tool is circular in cross-section which prevents fracture or laceration when the tool is being used on a human subject.

BRIEF DESCRIPTION OF THE DRAWINGS

For a more complete understanding of the present invention and the advantages thereof, reference is now made to the following description taken in conjunction with the accompanying drawings in which like reference numbers indicated like features and wherein:

FIG. 1 illustrates a side view and cross-section of the present invention;

FIG. 2 illustrates jabbing with the present invention;

FIG. 6 illustrates catching the leg of a human subject that is trying to kick and controlling him with the present invention;

FIG. 7 illustrates controlling the leg of a human subject who is holding onto a stationary object or fighting with someone with the present invention;

FIG. 8 illustrates a one-handed wristlock of a human subject with the present invention;

FIG. 9 illustrates setting the present invention and pulling a human subject to the ground;

FIG. 10 illustrates taking a human subject to the ground with the present invention and using the foot to control the human subject;

DETAILED DESCRIPTION OF THE INVENTION

Figure 4A:
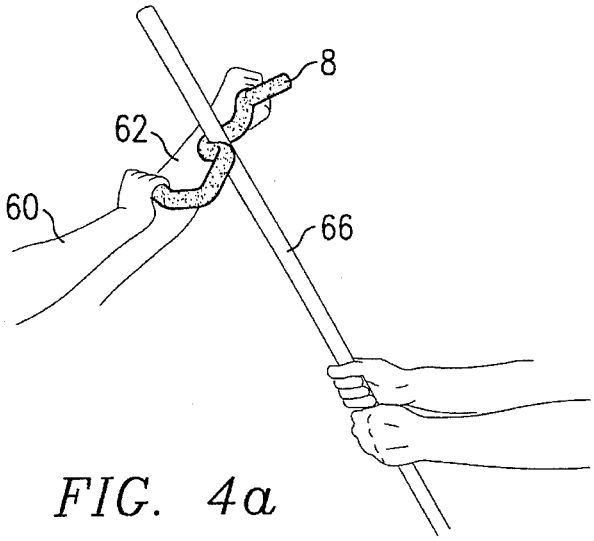
FIG. 4*a* illustrates two-handed blocking with the present invention.

Referring to FIG. 1, a passive control tool 8 is shown to comprise a ball 10 which is connected to a handle 12. Tool 8 further comprises an arm 14 connected to the handle 12 and to a weapon trap 16. A striking base 18 is connected to the weapon trap 16 and to a pocket 20. The weapon trap 16, the striking base 18 and the portion of the tool 8 connecting the weapon trap 16 to the handle 12 comprise the body 19 of the passive control tool 8. An arm trap 22 is connected to the pocket 20 and to a hook 24. The passive control tool 8 has an overall length of approximately 20¾ inches indicated at reference number 30. Tool 8 is circular in cross-section with a diameter of 1 inch as indicated at reference number 32. The length of the handle 12, indicated at 34, is approximately 4 inches. The length of the arm 14, indicated at 36, is approximately 3⅝ inches. The length of the weapon trap 16, indicated at 38, is also approximately 4½ inches. The depth of the weapon trap 16, indicated at 40, is approximately 1¾ inches. The width of the pocket 20, indicated at 42, is approximately 2⅞ inches, and the width from the arm trap 22 to the striking base 18, indicated at 44, is approximately 2¾ inches. The width from the hook 24 to the weapon trap 16, indicated at 46, is approximately 3⅝ inches, and the length of the pocket 20, arm trap 22 and hook 24, indicated at 48, is approximately 13 inches.

The ball 10 is substantially spherical and on the order of 1½ inches in diameter. One of the functions of ball 10 is to apply pressure to pressure points of a human subject. The ball 10 is primarily used for jabbing with the passive control tool 8 inverted with the arm 14 up. When the arm 14 is inverted to the up position and is held with one hand and the other hand is holding on to the pocket 20, a jab or pressure is exerted with the ball 10. For instance, the ball 10 is used for breaking glass, jabbing the sternum or solar plexus, or jabbing the gut for riot control purposes. A second function of the ball 10 is to act as a stopping point to prevent the passive control tool 8 from being extracted from the peace officer's hand. The ball 10 acts as a stopping point if the passive control tool 8 is pulled by a human subject. The handle 12 is the primary handle of the passive control tool 8 and is where the tool 8 is held for striking, setting the tool 8, and two-handed blocking. One function of the arm 14 is as an additional handle for jabbing. The passive control tool 8 may be inverted to where the arm is inverted to the up position with one hand on the arm 14 and the other hand on the pocket 20. An additional function of the arm 14 is to provide a protection to the peace officer's hand when performing the two-handed blocking. If something hits the striking base 18 or the weapon trap 16, the hand on the handle 12 is protected by the arm 14. During use of the tool 8 in passive restraint, the arm 14 also provides an additional lever after the tool 8 is set. The arm 14 allows for pressure to be exerted three to four inches off of the long axis of the tool 8 to apply leverage to twist the tool 8 around its long axis.

One function of the weapon trap 16 is to trap a weapon swung at the peace officer. As long as the peace officer is blocking in the area inward from the arm 14 and inward from the pocket 20, the weapon that is blocked will usually recoil itself into the weapon trap 16. This will create a static portion of the attack. This static portion is enough time for the peace officer to do a rolling motion with the passive control tool 8 which extracts the weapon from the human subject's hand at the same time it locks the subject in the passive control tool 8. Another function of the weapon trap 16 is as a secondary arm trap. If the human subject has his wrist or arm in the pocket 20 and is within the realm of the arm trap 22 and he starts to slip out, the weapon trap 16 will help keep him from completely evading the passive control tool 8. The weapon trap 16 will also act as a secondary pressure point by applying pressure to the human subject in the area four inches below where the arm trap 22 started the initial contact.

The striking base 18 is used when the tool 8 is to be swung or used as a baton. The striking base 18 is especially effective for striking because of the additional weight of the remaining portions of tool 8 set approximately 4¾ to 7¼ inches behind the striking base 18.

The pocket 20 is primarily used as a trap. The pocket 20 is the holding and restraining portion of the passive control tool 8 and may be used on the arm, leg, biceps, or any appendage of a human subject. Secondly, as discussed previously, the pocket 20 is used as a handle for jabbing.

The arm trap 22 is a crook between the hook 24 and the pocket 22. One function of the arm trap 22 is to trap an appendage. When the passive control tool 8 is twisted, the arm trap 22 prevents the human subject from turning his arm down. A secondary function of the arm trap 22 is to apply pressure into bone pressure regions of the arm, leg, biceps, or other appendages trapped in the tool 8. The arm trap 22 is also the beginning apex for the hook 24 when the hook 24 is used as a handle.

One function of the hook 24 is to act as a guide to lead the passive control tool 8 around whatever appendage of a human subject is to be trapped. The end of the hook 24 is tapered slightly to enhance its function as a guide. A second function of the hook 24 is as a handle for one-handed blocks. This is because the line of force created by the energy required to hold the tool by the handle during a block would cause the passive control tool 8 to turn in the hand of the user. However, a gripping point placed behind the line of force of an attack allows all the energy to be disbursed throughout the passive control tool 8 and places the holding point of the tool 8 such that the tool 8 will not turn in the hands of the user when struck. The hook 24 is also used as a handle during two-handed blocking.

The passive control tool 8 is approximately one inch in diameter in order to be easy to grip in the hand. The tool 8 may be, for example, substantially circular in cross-section so that there are no sharp edges that could cut or bruise a subject's skin or fracture bone during use of the tool 8.

According to one embodiment of the present invention, a thin slip-resistant padding can be incorporated into either handle 12, hook 24 or both. This padding may comprise, for example, rubber, neoprene or other suitable material. These grip areas result in a more secure grip of the tool 8 and can further buffer impacts to the user of the tool 8 when the tool 8 is used for blocking or striking.

The passive control tool 8 of the present invention may comprise, for example, glass reinforced urethane, polycarbonate or other similar substantially rigid material. According to one embodiment of the present invention, the tool 8 comprises a ratio of glass to urethane to create a glass reinforced urethane material. Overall, the passive control tool is roughly 21 inches in length and weighs roughly one and one-half pounds.

FIGS. 2 through 17 illustrate a variety of methods of the present invention for using the passive control tool 8. In general, the passive control tool 8 of the present invention is used to control a subject by trapping an appendage of the subject in the pocket 20 of the tool 8 and applying twisting force to the tool 8 to hold the appendage in the pocket 20. The subject is trapped by setting the hook 24 around the appendage and flipping the tool 8 to trap the appendage. The subject can then be controlled by applying the twisting force described previously. In some cases, this twisting force can be applied with one arm leaving the remaining arm free for other activity.

Referring to FIG. 2, the passive control tool 8 is shown in use for jabbing to the solar plexus. A peace officer using the passive control tool 8 grips it with one arm 60 by the pocket 20 of the passive control tool 8 and grips it with the other arm 62 by the arm 14 of the passive control tool 8. The peace officer then uses the ball 10 of the tool 8 to jab into the solar plexus of the human subject 64. In this configuration and using this method, the passive control tool 8 can also be used to jab other portions of a human subject, to put pressure on and break glass, or for other similar functions.

Figure 3:
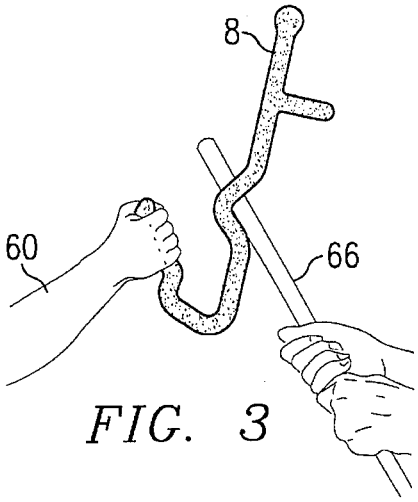
FIG. 3 illustrates one-handed blocking with the present invention.

Referring to FIG. 3, the passive control tool 8 is shown in use for one-handed blocking. A peace officer grips the passive control tool 8 with one arm 60. The passive control tool 8 is then used to block a weapon 66 wielded by a human subject. In this manner of blocking, the peace officer's arm is protected from the weapon 66 wielded by the human subject because the arm 60 is behind the blocking surface, the body 19, of the passive control tool 8.

Figure 4B:
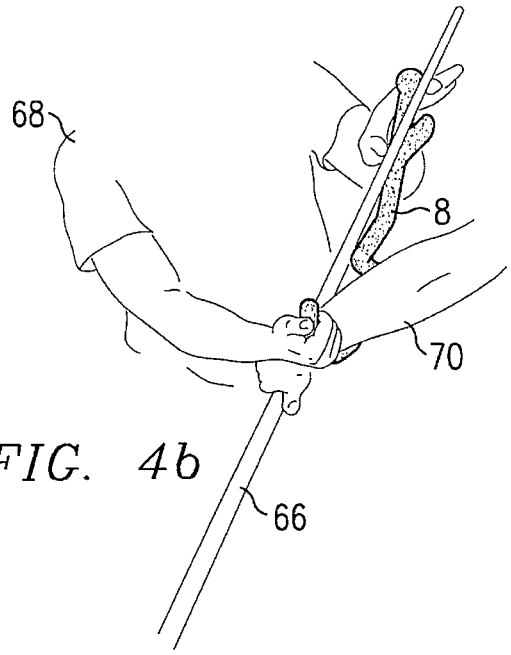
FIG. 4*b* illustrates weapon disarming after performing a one-handed or two-handed block with the present invention.

Referring to FIGS. 4*a* and 4*b*, the passive control tool 8 is shown in use for two-handed blocking and weapon disarming. As shown in FIG. 4*a*, a peace officer holds the tool 8 with one arm 60 gripping the hook 24 of the passive control tool 8 and with the other arm 62 gripping the handle 12 of the passive control tool 8. According to this method, the passive control tool 8 allows the peace officer to block a weapon 66 wielded by a human subject. Both hands of the police officer are protected by the passive control tool 8. The hand 62 is protected by the arm 14 of the passive control tool 8 and the hand 60 is protected as was described with reference to FIG. 3.

As shown in FIG. 4*b*, the passive control tool 8 is used to disarm the weapon 66 wielded by the human subject. After performing the one or two-handed blocks, the peace officer 68 uses the tool 8 to remove the weapon 66 from the human subject's possession and to trap the arm 70 of the human subject into the pocket 20 of the passive control tool 8. Using this method, the peace officer is able to both disarm and control the human subject.

Figure 5:
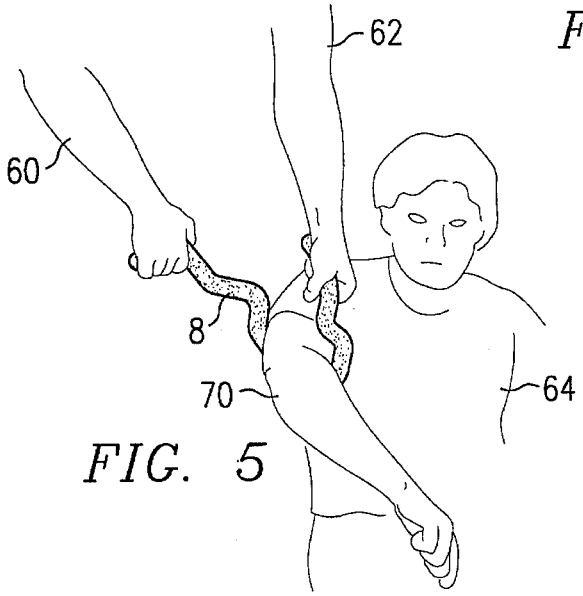
FIG. 5 illustrates extracting a human subject that does not want to move with the present invention.

Referring to FIG. 5, the passive control tool 8 is shown in use for extracting a human subject 64 who does not want to move. A peace officer holds the passive control tool 8 by the arm 14 with one of his arms 60 and holds the passive control tool 8 by the hook 20 with his other arm 62. With the passive control tool 8 set under the human subject's arm 70, the peace officer is able to remove the human subject who does not want to stand up and move. The peace officer can twist the passive control tool 8 and apply pressure into the arm 70 of the human subject to encourage the human subject to move with the peace officer.

Referring to FIG. 6, the passive control tool 8 is shown in use for catching the leg 72 of a human subject that is trying to kick and controlling the human subject. The passive control tool 8 is held by its handle 12 and by its hook 24 and is used to catch the leg 72 of the human subject. Once the peace officer has caught the human subject's leg 72, the peace officer can twist the passive control tool 8 and apply pressure into the leg 72 of the human subject. By applying this pressure, the peace officer can control the human subject.

Referring to FIG. 7, the passive control tool 8 is shown in use for controlling the leg 72 of a human subject who is holding onto a stationary object or who is fighting with someone. A peace officer grips the passive control tool 8 by its arm 14 and by its hook 24 and sets the passive control tool 8 around the leg 72 of the human subject. With the passive control tool 8 in this configuration, the peace officer can apply pressure to the leg 72 of the human subject. By applying this pressure, the peace officer can control the human subject and convince the human subject to let go of the stationary object or to quit fighting.

Referring to FIG. 8, the passive control tool 8 is shown in use for a one-handed wristlock of a human subject 64. The passive control tool 8 is held by the hook 24 by one arm 62 of the peace officer 68. The peace officer 68 has set the passive control tool 8 around the arm 70 of the human subject 64. By applying pressure with his forearm, the peace officer 68 can trap and control the arm 70 of the human subject 64. In this way, the peace officer 68 can hold the human subject 64 in a wristlock using the tool 8 and only one arm leaving the peace officer's remaining arm free for other uses.

Referring to FIG. 9, the passive control tool 8 is shown in use for setting the tool 8 and pulling a human subject 64 to the ground. A peace officer pushes the passive control tool 8 by the hook 24 with one arm 60 and by the arm 14 with his other arm 62. With the human subject's arm 70 set within the passive control tool 8 the peace officer can apply twisting motion to the tool 8 and restrain the human subject 64. In this way, the peace officer can force the human subject 64 to the ground forcing him under the control of the peace officer.

Referring to FIG. 10, the passive control tool 8 is shown in use for taking a human subject 64 to the ground and controlling him using a foot 72. A peace officer 68 applies pressure to the passive control tool 8 with his foot 72 to hold the human subject 64 to the ground by his arm 70. With the passive control tool 8 in this configuration, the peace officer 68 can hold the human subject 64 for as long as he desires using only pressure from his foot.

Figure 11:
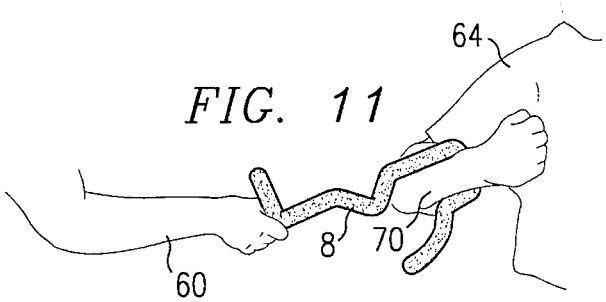
FIG. 11 illustrates stopping a human subject from punching or grabbing someone else with the present invention.

Referring to FIG. 11, the passive control tool 8 is shown in use for stopping a human subject 64 from punching or grabbing someone else. A peace officer, gripping the passive control tool by its handle 12 with one arm 60, can set the tool 8 around an arm 70 of the human subject 64. In this manner, the peace officer can prevent the human subject 64 from using his arm 70 to punch someone or to grab someone. The tool allots the officer up to 4 feet of reach in which to accomplish this action.

Figure 12:
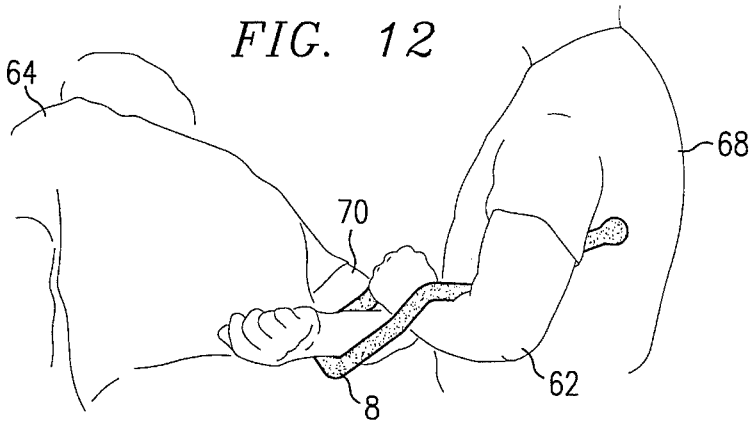
FIG. 12 illustrates hooking someone from behind and escorting them using one arm with the present invention.

Referring to FIG. 12, the passive control tool 8 is shown in use for hooking a human subject 64 from behind and escorting him with one arm. A peace officer 68 has the human subject 64 held in the pocket 20 of the passive control tool 8. With the human subject's arm 70 in the passive control tool 8, the peace officer 68 can control the human subject 64 using only his arm 62. As shown in FIG. 12, the peace officer 68 has the ball 10 and arm 14 of the passive control tool 8 under his shoulder. In this manner, the peace officer 68 can push down with his arm 62 and twist the passive control tool 8. This twisting motion forces the human subject 64 to remain in the control of the peace officer 68. The peace officer 68 can escort the human subject 64 using the pressure of his arm and keep the human subject 64 under his control.

Figure 13:
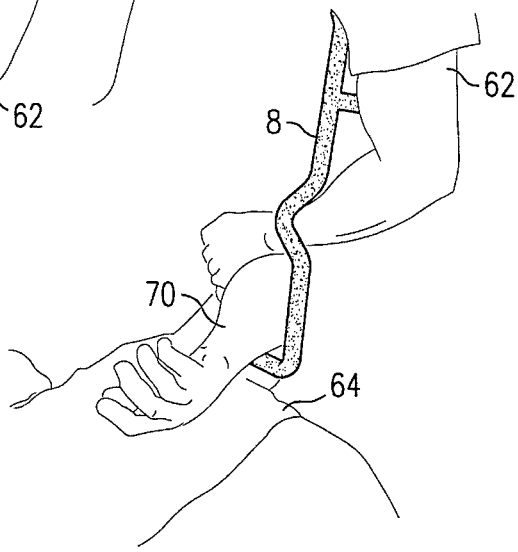
FIG. 13 illustrates taking a human subject to the ground with the present invention using only one arm.

Referring to FIG. 13, the passive control tool 8 is shown in use for taking a human subject 64 to the ground using only one arm. A peace officer can use only one arm 62 to trap and control a human subject 64 by the subject's arm 70. With the human subject's arm 70 in the pocket 20 of the passive control tool 8, the peace officer can push the passive control tool 8 with his hand on the hook 24 and the ball 10 under his arm. By applying pressure to the passive control tool 8 with his arm 62 and hand, the peace officer can twist the passive control tool 8 and control the human subject 64.

Figure 14:
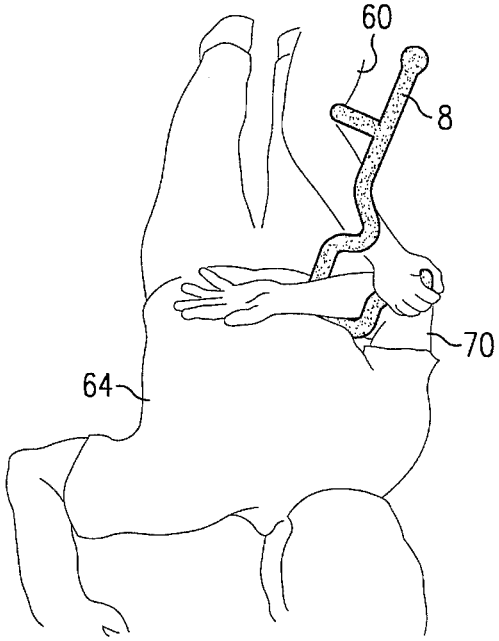
FIG. 14 illustrates one-armed control and takedown with a human subject in a handcuffed position with the present invention.

Referring to FIG. 14, the passive control tool 8 is shown in use for one-arm control and take down of a human subject 64 in a handcuffed position. A peace officer holds the passive control tool 8 with one arm 60 gripping the hook 24. The human subject 64 has his arm 70 set in the passive control tool 8. The peace officer controls the passive control tool 8 with one hand on the hook 24 and with the arm 14 of the passive control tool 8 under his arm 60. In this way, the peace officer can apply pressure with his arm 60 and twist the passive control tool 8. This twisting allows the peace officer to apply pressure to the human subject's arm 70 and control the human subject 64.

Figure 15:
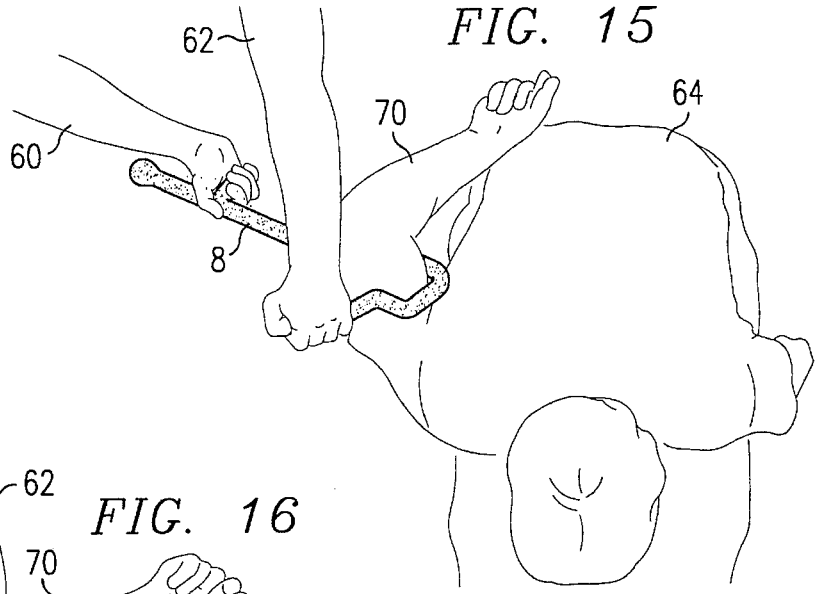
FIG. 15 illustrates two-handed bicep escorting with the present invention.

Referring to FIG. 15, the passive control tool 8 is shown in use for a two-handed bicep escort. The peace officer holds the passive control tool 8 with one arm 60 gripping the arm 14 of the passive control tool 8, and one arm 62 gripping the hook 24. With an arm 70 of a human subject 64 set in the passive control tool 8, the peace officer can control the human subject 64. By twisting the passive control tool 8, the peace officer can apply pressure into the arm 70 of the human subject 64 and fold the human subject 64 into a bent position. In this way, the peace officer can escort the human subject 64 by applying pressure to the bicep of the human subject 64.

Figure 16:
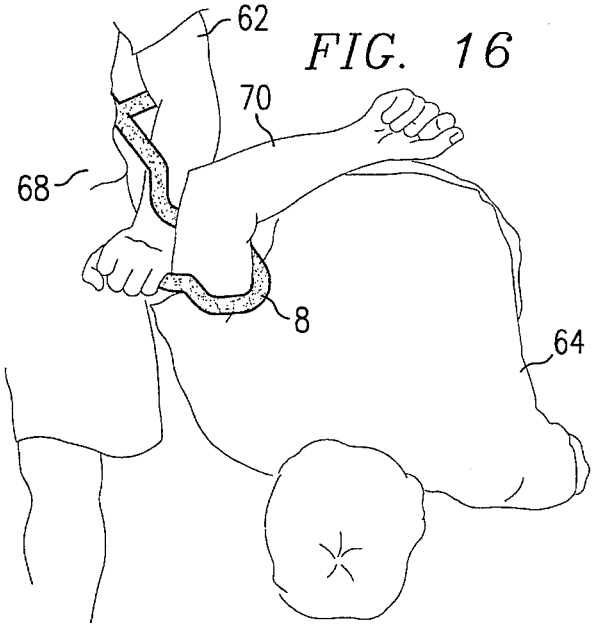
FIG. 16 illustrates one-handed bicep escorting with the present invention.

Referring to FIG. 16, the passive control tool 8 is shown in use for a one-handed bicep escort. A peace officer 68 using one arm 62 can grip the hook 24 of the passive control tool 8 with the arm 70 of the human subject 64 set in the passive control tool 8. The peace officer 68 can control the human subject 64 by applying pressure with his upper arm and hand. The peace officer 68 can twist the passive control tool 8 and apply pressure into the arm 70 of the human subject. This pressure allows the peace officer 68 to control the human subject 64 similar to the manner discussed with reference to FIG. 15. The pressure into the bicep of the human subject allows the officer 68 to control the human subject 64 and lead him by the bicep.

Figure 17:
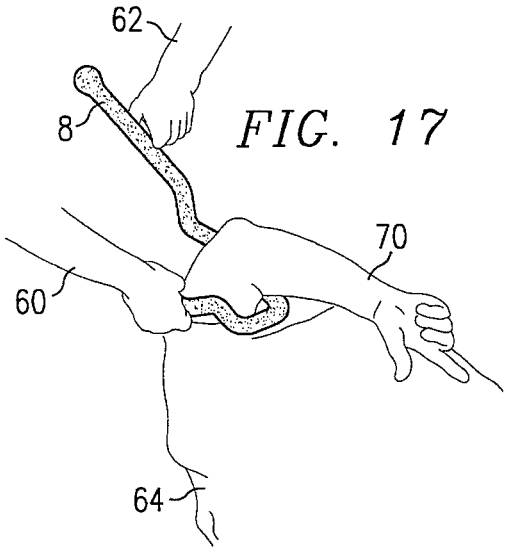
FIG. 17 illustrates two-handed bicep takedown with a human subject in a handcuffed position with the present invention.

Referring to FIG. 17, the passive control tool 8 is shown in use for a two-handed bicep takedown with the human subject 64 in a handcuffed position. A peace officer can hold the passive control tool 8 with one arm 62 gripping the arm 14 of the passive control tool 8 and with the other arm 60 gripping the hook 24 of the passive control tool 8. With the arm 70 of the human subject 64 set in the pocket 20 of the passive control tool 8, the peace officer can apply pressure to the arm 70 of the human subject 64. By pulling up with his arm 62 and pushing down with his arm 60, the peace officer can apply pressure into the bicep of the human subject 64. This pressure allows the peace officer to hold the arm 70 of the human subject 64 in the handcuffed position and control the human subject 64.

Figure 18:
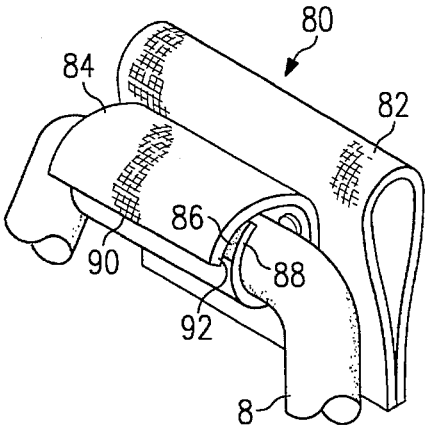
FIG. 18 illustrates a holster that may be used in conjunction with the passive restraint device of the present invention.

FIG. 18 illustrates a holster 80 which may be used with a tool 8 and which comprises a belt loop 82 and a retention strap 84. Belt loop 82 and retention strap 84 may comprise saddle-grade leather. Retention strap 84 may be stitched and riveted to belt loop 82. In operation, belt loop 82 is worn on a belt around the waist of a peace officer using the tool 8. Holster 80 is shown holding tool 8. Retention strap 84 comprises a first fabric hook and loop fastener surface 86 formed on the lower lip 88 of retention strap 84. A similar fabric hook and loop fastener surface 90 is attached to the inner surface of an upper lip 92 of retention strap 84. Fabric hook and loop fastener surfaces 90 and 88 mate according to the conventional operation of a fabric hook and loop fastener to secure tool 8 within holster 80. Tool 8 may be advantageously worn in holster 80 with the hook of tool 8 facing forward and the arm of tool 8 facing rearward. The officer using the tool can easily retrieve the tool 8 from holster 80 by applying upper pressure on lip 92 and extracting the tool 8 from holster 80 in a single motion and using only one hand to do so.

Generally in use, the passive control tool 8 is used by setting the pocket 20 with one arm, grabbing the hook 24 with the other arm, and flipping the passive control tool 8. The passive control tool 8 may then be used to control the human subject by applying force to the subject's appendages through the tool 8. This three-step process of setting, flipping, and controlling is the basic process used to control a human subject with the passive control tool 8 of the present invention.

One advantage of the passive control tool, therefore, is that it allows control of the human subject with one arm once the passive control tool has been set. A second advantage of the present invention is that it is substantially circular in cross section and therefore prevents fracture or laceration of a human subject while the passive control tool is being used on the human subject.

Although the present invention has been described in detail, it should be understood that various changes, substitutions and alterations can be made hereto without departing from the spirit and scope of the invention as defined by the appended claims.

What is claimed is:

1. A passive restraint device comprising:

a handle having a first end and a second end;

an arm coupled to the handle proximate the second end of the handle, the arm extending substantially perpendicular to the handle;

a body having a first end and a second end, the first end of the body coupled to the second end of the handle, such that the body extends substantially co-axially with the handle;

a pocket having a first end and a second end such that the first end of the pocket is positioned substantially opposite the second end of the pocket, the first end of the pocket coupled to the second end of the body, such that the pocket extends from the striking base in a direction opposite the arm;

an arm trap having a first end and a second end, the first end of the arm trap coupled to the second end of the pocket, such that the arm trap is positioned opposite the body and spaced apart by a width; and a hook having a first end and a second end, the first end of the hook coupled to the second end of the arm trap, the hook extending from the arm trap substantially toward the handle such that the hook is positioned opposite the body and spaced apart by a width, wherein the length from the body to the handle is greater than the length from the arm trap to the hook such that the passive restraint device can be used to set an appendage of a human subject in the pocket.

2. The passive restraint device of claim 1 wherein the body comprises:

a weapon trap coupled to the first end of the handle; and a striking base coupled to the weapon trap.

3. The passive restraint device of claim 1 further comprising a substantially spherical ball coupled to the handle proximate the second end of the handle.

4. The passive restraint device of claim 3 wherein the passive restraint device has an overall length from the substantially spherical ball to the pocket of approximately twenty-one inches.

5. The passive restraint device of claim 1 wherein the passive restraint device has a substantially circular cross-section.

6. The passive restraint device of claim 5 wherein the substantially circular cross-section is substantially constant over the entirety of the passive restraint device and comprises a diameter of approximately one inch.

7. The passive restraint device of claim 1 further comprising a grip disposed on an outer surface of the handle.

8. The passive restraint device of claim 1 further comprising a grip disposed on an outer surface of the hook.

9. The passive restraint device of claim 1, wherein the passive restraint device is constructed from urethane.

10. The passive restraint device of claim 9, wherein the passive restraint device is constructed from glass-reinforced urethane.

11. The device of claim 1 and further comprising a holster operable to hold the device comprising a retention strap comprising book and loop fasteners operable to selectably close the retention strap around the tool.

12. A passive control tool, comprising:

a handle having a first end and a second end;

a substantially spherical ball coupled to the first end of the handle;

an arm coupled to the handle proximate the second end of the handle, the arm extending substantially perpendicular to the handle;

a weapon trap having a first end and a second end, the first end of the weapon trap coupled to the second end of the handle, such that a mid-point of the weapon trap extends from the handle in a direction opposite the arm;

a striking base having a first end and a second end, the first end of the striking base coupled to the second end of the weapon trap, the striking base extending from the weapon trap substantially co-axially with the handle;

a pocket having a first end and a second end such that the first end of the pocket is positioned substantially opposite the second end of the pocket, the first end of the pocket coupled to the second end of the striking base such that the pocket extends from the striking base in a direction opposite the arm;

an arm trap having a first end and a second end, the first end of the arm trap coupled to the second end of the pocket, such that the arm trap is positioned substantially opposite the striking base and spaced apart by a width; and a hook having a first end and a second end, the first end of the hook coupled to the second end of the arm trap, the hook extending from the arm trap substantially toward the handle such that the hook is positioned substantially opposite the weapon trap and spaced apart by a width, and wherein the length from the striking base to the handle is greater than the length from the arm trap to the hook such that the passive control tool can be used to set an appendage of a human subject in the pocket.

13. The passive control tool of claim 12 wherein the passive control tool has an overall length from the substantially spherical ball to the pocket of approximately twenty-one inches.

14. The passive control tool of claim 12 further comprising a substantially spherical ball coupled to the end of the arm distal to the handle.

15. The passive control tool of claim 12 wherein the passive control tool has a substantially circular cross-section.

16. The passive control tool of claim 15 wherein the substantially circular cross-section is substantially constant over the entirety of the passive control tool and comprises a diameter of approximately one inch.

17. The passive control tool of claim 12, wherein the passive restraint device is constructed from urethane.

18. The passive control tool of claim 17, wherein the passive restraint device is constructed from glass-reinforced urethane.

19. The passive control tool of claim 12 further comprising a grip disposed on an outer surface of the handle.

20. The passive control tool of claim 12 further comprising a grip disposed on an outer surface of the hook.

* * * * *